US010608332B2

(12) United States Patent
Nishimoto et al.

(10) Patent No.: US 10,608,332 B2
(45) Date of Patent: Mar. 31, 2020

(54) MICROSTRIP ANTENNA

(71) Applicant: DENSO TEN Limited, Kobe-shi, Hyogo (JP)

(72) Inventors: Norihisa Nishimoto, Kobe (JP); Kenji Oka, Kobe (JP); Junzoh Tsuchiya, Kobe (JP); Ryuichi Hashimoto, Kobe (JP); Kenta Shirahige, Kobe (JP)

(73) Assignee: DENSO TEN Limited, Kobe-shi (JP)

( * ) Notice: Subject to any disclaimer, the term of this patent is extended or adjusted under 35 U.S.C. 154(b) by 0 days.

(21) Appl. No.: 15/834,594

(22) Filed: Dec. 7, 2017

(65) Prior Publication Data

US 2018/0198198 A1 Jul. 12, 2018

(30) Foreign Application Priority Data

Jan. 11, 2017 (JP) ..... 2017-002809

(51) Int. Cl.
*H01Q 1/52* (2006.01)
*H01Q 1/36* (2006.01)
*H01Q 9/04* (2006.01)

(52) U.S. Cl.
CPC ..... *H01Q 1/52* (2013.01); *H01Q 1/36* (2013.01); *H01Q 9/0407* (2013.01)

(58) Field of Classification Search
CPC ..... H01Q 1/52–1/523; H01Q 9/0407; H01Q 1/38
USPC ..... 343/700 MS
See application file for complete search history.

(56) References Cited

U.S. PATENT DOCUMENTS 4,218,682 A * 8/1980 Frosch ..... H01Q 9/0414 343/700 MS
4,401,988 A * 8/1983 Kaloi ..... H01Q 19/005 343/700 MS
5,121,127 A * 6/1992 Toriyama ..... H01Q 9/0414 343/700 MS
6,639,558 B2 * 10/2003 Kellerman ..... H01Q 9/0414 343/700 MS
7,079,079 B2 * 7/2006 Jo ..... H01Q 1/243 343/700 MS
2005/0195110 A1 * 9/2005 Lin ..... H01Q 1/38 343/700 MS
2009/0058731 A1 * 3/2009 Geary ..... H01Q 9/0414 343/700 MS
2016/0301129 A1 * 10/2016 Ying ..... H01Q 1/523

FOREIGN PATENT DOCUMENTS

JP H11-284429 A 10/1999
JP 2012-159349 A 8/2012
JP 2014-165529 A 9/2014

* cited by examiner

*Primary Examiner* — Dameon E Levi
*Assistant Examiner* — Hasan Z Islam
(74) *Attorney, Agent, or Firm* — Oliff PLC

(57) ABSTRACT

There is provided a microstrip antenna. A plurality of dielectric layers are stacked. An antenna is provided on the uppermost dielectric layer of the plurality of dielectric layers. Conductor layers are respectively provided on lower surfaces of the dielectric layers. The conductor layers have different dimensions in a plane direction thereof so that electromagnetic waves to be radiated from the conductor layers are cancelled with each other.

1 Claim, 4 Drawing Sheets

MICROSTRIP ANTENNA

CROSS-REFERENCE TO RELATED APPLICATIONS

This application is based on and claims priority from Japanese Patent Application No. 2017-002809 filed on Jan. 11, 2017.

TECHNICAL FIELD

The disclosure relates to a microstrip antenna.

BACKGROUND

In the related art, for a radar device to be mounted to a moving body such as an automobile, a microstrip antenna is used as an inexpensive and small-scaled antenna, for example. The microstrip antenna includes a plurality of stacked dielectric layers, conductor layers provided on lower surfaces of the respective dielectric layers, and an antenna provided on the uppermost dielectric layer of the plurality of dielectric layers (for example, refer to Patent Document 1).

Patent Document 1: Japanese Patent Application Publication No. 2014-165529A

However, in the microstrip antenna, an electromagnetic wave may be radiated from the conductor layer. In this case, an electromagnetic wave to be radiated from the antenna and the electromagnetic wave to be radiated from the conductor layer interfere with each other, so that directionality of the antenna is badly influenced.

SUMMARY

It is therefore an object of an aspect of the present invention to provide a microstrip antenna capable of suppressing a bad influence on directionality of an antenna.

According to an aspect of the embodiments of the present invention, there is provided a microstrip antenna comprising: a plurality of stacked dielectric layers; an antenna provided on the uppermost dielectric layer of the plurality of dielectric layers; and conductor layers respectively provided on lower surfaces of the dielectric layers, the conductor layers having different dimensions in a plane direction thereof so that electromagnetic waves to be radiated from the conductor layers are cancelled with each other.

With the above configuration, the microstrip antenna can suppress a bad influence on the directionality of the antenna.

DETAILED DESCRIPTION OF THE EMBODIMENTS

Hereinafter, an illustrative embodiment of a microstrip antenna disclosed herein will be described in detail with reference to the accompanying drawings. In the meantime, the disclosure is not limited to the illustrative embodiment to be described later. Herein, a microstrip antenna configured to radiate an electromagnetic wave for target detection by a radar device to a surrounding in a wide angle is exemplified.

Figure 1:
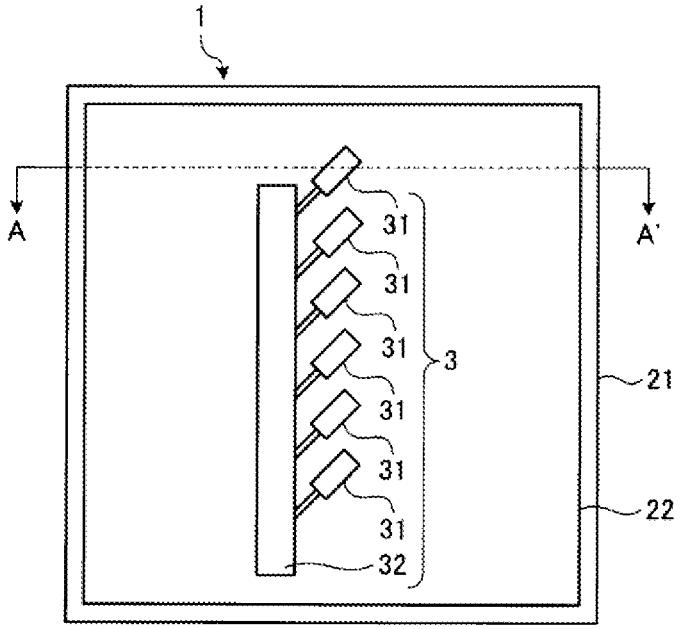
FIG. 1 is a plan view illustrating a microstrip antenna in accordance with an illustrative embodiment.
Figure 2:
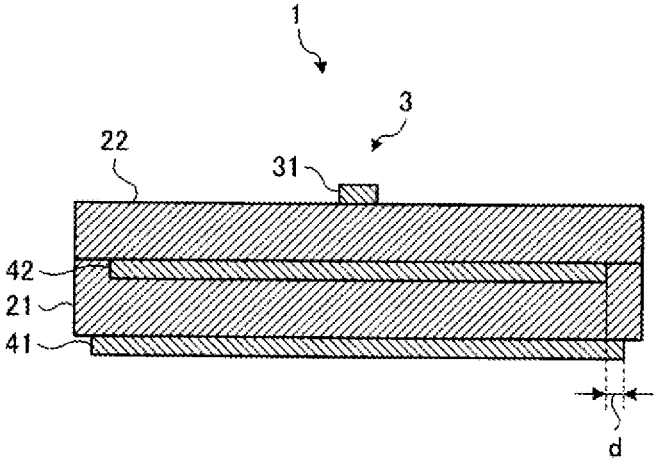
FIG. 2 is a sectional view taken along a line A-A' of FIG. 1 depicting the microstrip antenna in accordance with the illustrative embodiment.

FIG. 1 is a plan view illustrating a microstrip antenna 1 in accordance with an illustrative embodiment. FIG. 2 is a sectional view taken along a line A-A' of FIG. 1 depicting the microstrip antenna 1 in accordance with the illustrative embodiment. In the meantime, in FIG. 1, the microstrip antenna 1 arranged in parallel with a horizontal plane is shown, as seen from above in a vertical direction. In the below, the above in the vertical direction is referred to as 'upper' and the lower in the vertical direction is referred to as 'lower'.

As shown in FIG. 1, the microstrip antenna 1 includes a first dielectric layer 21, a second dielectric layer 22 stacked on the first dielectric layer 21, and an antenna 3 provided on the second dielectric layer 22. In the meantime, the microstrip antenna 1 may have a configuration where three or more dielectric layers are stacked and the antenna 3 is provided on the uppermost dielectric layer.

Also, in FIG. 1, one transmission antenna configured to output an electromagnetic wave is exemplified. However, the illustrative embodiment can also be applied to a plurality of transmission antennas. Also, the illustrative embodiment can be applied to one receiving antenna or a plurality of receiving antennas.

The first dielectric layer 21 and the second dielectric layer 22 are formed of fluorine resin, liquid crystal polymer, ceramic, Teflon (registered trademark) or the like, for example. Also, the antenna 3 is formed of copper, for example. The antenna 3 includes a plurality of radiation elements 31, and a power feeding line 32 configured to feed high-frequency power to each radiation element 31.

Also, as shown in FIG. 2, the microstrip antenna 1 includes a first conductor layer 41 provided on a lower surface of the first dielectric layer 21 and a second conductor layer 42 provided on a lower surface of the second dielectric layer 22. The first conductor layer 41 and the second conductor layer 42 are ground (GND) patterns formed of copper, for example. In the meantime, when the microstrip antenna 1 has three or more stacked dielectric layers, a conductor layer is provided on a lower surface of each dielectric layer.

The microstrip antenna 1 is connected to an MIMIC (Monolithic Microwave Integrated Circuit), for example. When a microwave signal modulated and amplified is supplied from the MIMIC to the power feeding line 32, an electromagnetic wave is radiated from each radiation element 31.

At this time, in the microstrip antenna 1, a current (surface current) flows on a surface of the second conductor layer 42 due to an electric field that is formed between the radiation element 31 and the second conductor layer 42 of the antenna 3 when radiating the electromagnetic wave. Also, the electromagnetic wave propagates in the second dielectric layer 22.

The surface current and the propagating electromagnetic wave are transmitted to an end portion of the second conductor layer 42 and an end portion of the first conductor layer 41, and are diffracted at the end portions of the first conductor layer 41 and the second conductor layer 42, so that the radiation is generated from the end portions of the first conductor layer 41 and the second conductor layer 42. By the radiation from the end portions of the first conductor layer 41 and the second conductor layer 42, the directionality of the antenna is badly influenced.

Therefore, in the microstrip antenna 1, dimensions in a plane direction of the first conductor layer 41 and the second conductor layer 42 are made different so that the electromagnetic waves to be radiated from the first conductor layer 41 and the second conductor layer 42 are to be cancelled with each other.

For example, as shown in FIG. 2, in the microstrip antenna 1, an area of a surface of the first conductor layer 41 parallel with the horizontal plane is made greater than an area of the second conductor layer 42 parallel with the horizontal plane. Also, in the microstrip antenna 1, each side end surface of the first conductor layer 41 is made to more protrude outward in the horizontal direction than each side end surface of the second conductor layer 42 by a width d.

The width d is determined by a simulation to be described later so that phases of the electromagnetic wave to be radiated from the first conductor layer 41 and the electromagnetic wave to be radiated from the second conductor layer 42 become antiphases with respect to each other and the electromagnetic waves to be radiated are thus to be cancelled with each other.

Thereby, the microstrip antenna 1 can suppress the bad influence on the directionality of the antenna 3, as compared to a microstrip antenna where a conductor layer and a dielectric layer of which planar shapes and dimensions in the plane direction are the same are sequentially stacked without considering the electromagnetic waves to be radiated.

Figure 3:
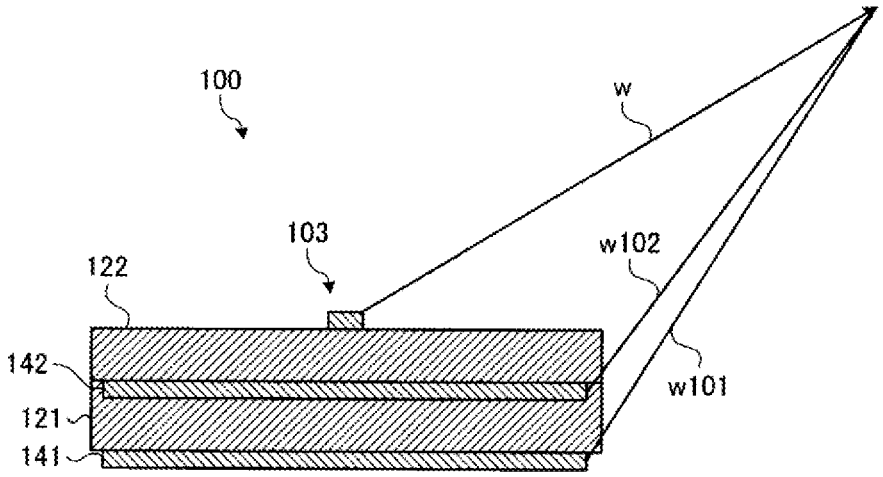
FIG. 3 is a sectional view illustrating a microstrip antenna in accordance with a comparative example of the illustrative embodiment.
Figure 4:
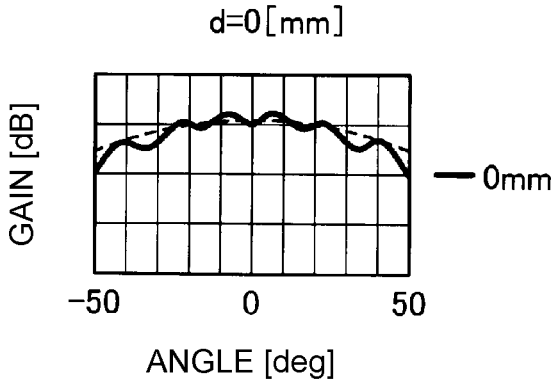
FIG. 4 illustrates a simulation result of a gain characteristic of the microstrip antenna in accordance with the comparative example of the illustrative embodiment.

In the below, operational effects of the microstrip antenna 1 in accordance with the illustrative embodiment are described, in contrast with the general microstrip antenna. FIG. 3 is a sectional view illustrating a microstrip antenna 100 in accordance with a comparative example of the illustrative embodiment. FIG. 4 illustrates a simulation result of a gain characteristic of the microstrip antenna 100 in accordance with the comparative example of the illustrative embodiment.

Figure 5:
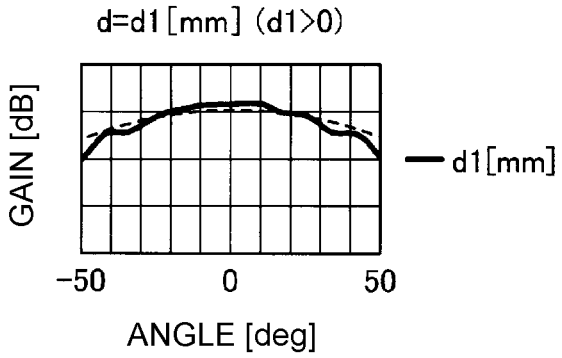
FIG. 5 illustrates a simulation result of a gain characteristic of the microstrip antenna in accordance with the illustrative embodiment.
Figure 6:
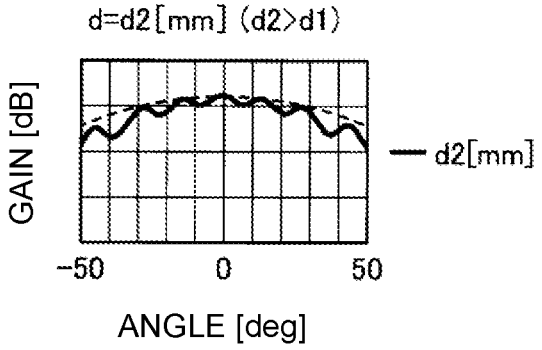
FIG. 6 illustrates a simulation result of the gain characteristic of the microstrip antenna in accordance with the illustrative embodiment.
Figure 7:
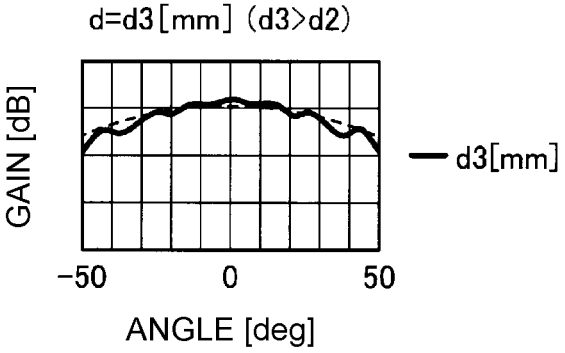
FIG. 7 illustrates a simulation result of the gain characteristic of the microstrip antenna in accordance with the illustrative embodiment.
Figure 8:
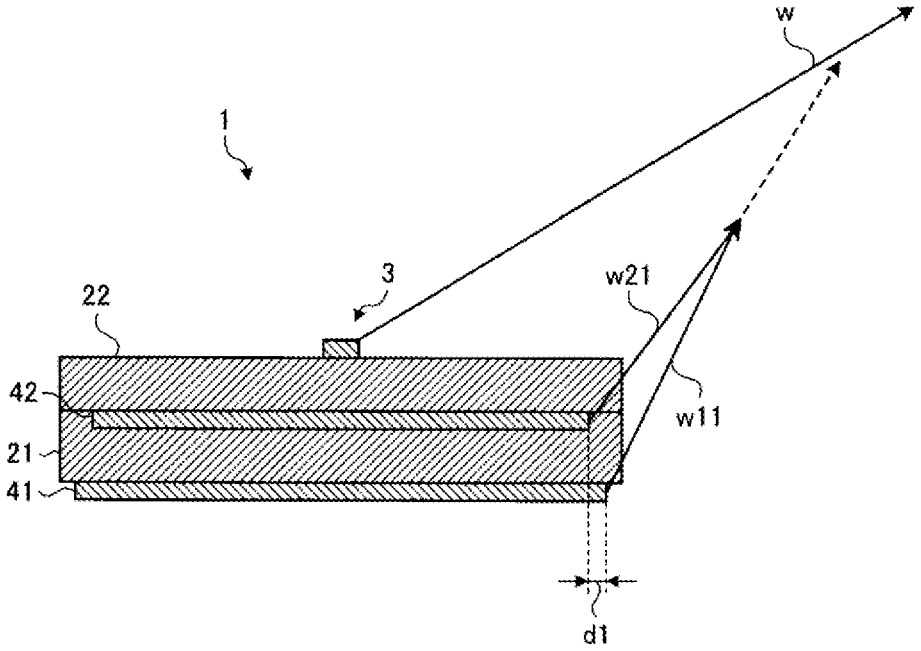
FIG. 8 illustrates operations of the microstrip antenna in accordance with the illustrative embodiment.

Also, FIGS. 5 to 7 illustrate simulation results of a gain characteristic of the microstrip antenna 1 in accordance with the illustrative embodiment. FIG. 8 illustrates operations of the microstrip antenna 1 in accordance with the illustrative embodiment.

As shown in FIG. 3, the microstrip antenna 100 of the comparative example has a structure where a first conductor layer 141 and a second conductor layer 142 of which planar shapes and dimensions in the plane direction are the same are stacked via a first dielectric 121 without considering the electromagnetic waves to be radiated. The microstrip antenna 100 has an antenna 103 provided on a second dielectric layer 122 stacked on the second conductor layer 142.

In the microstrip antenna 100, an electromagnetic wave W101 to be radiated from the first conductor layer 141 and an electromagnetic wave W102 to be radiated from the second conductor layer 142 and an electromagnetic wave W to be radiated from the antenna 103 interfere with each other, so that the electromagnetic wave W changes from an ideal gain characteristic.

For this reason, a simulation result of the gain characteristic of the microstrip antenna 100 is as shown in FIG. 4. In FIG. 4, a horizontal axis indicates a radiation angle [deg] of the electromagnetic wave W to be radiated from the antenna 103. Also, a vertical axis in FIG. 4 indicates a gain [dB] of the electromagnetic wave W to be radiated from the antenna 103.

Also, d=0 [mm] in FIG. 4 indicates that the width d shown in FIG. 2 is 0 [mm], i.e., the dimensions in the plane direction of the first conductor layer 141 and the second conductor layer 142 are the same. The bold solid line in FIG. 4 is a waveform indicative of the gain characteristic of the microstrip antenna 100, and the dotted line in FIG. 4 is a waveform indicative of the ideal gain characteristic.

As shown in FIG. 4, while the waveform of the ideal gain characteristic has a circular arc shape, the waveform indicating the gain characteristic of the microstrip antenna 100 has a ripple and a gain is not uniform due to the radiation angle. When the microstrip antenna 100 is applied to a radar device, the phase and the amplitude of the electromagnetic wave W to be radiated from the antenna 103 become irregular due to the radiation angle of the electromagnetic wave W, so that the target detection precision of the radar device is lowered.

Therefore, in the microstrip antenna 1 of the illustrative embodiment, the dimensions in the plane direction of the first conductor layer 41 and the second conductor layer 42 are made different so that the electromagnetic waves to be radiated from the first conductor layer 41 and the second conductor layer 42 are to be cancelled with each other. Thereby, the change of the ideal gain characteristic of the electromagnetic wave W is suppressed.

When the dimension in the plane direction of the first conductor layer 41 is changed, a path length from the radiation element 31 to the end portion of the first conductor layer 41 changes. For this reason, it is possible to change the phase of the electromagnetic wave to be radiated from the first conductor layer 41 by changing the dimension in the plane direction of the first conductor layer 41.

By using the above principle, the gain characteristic of the microstrip antenna 1 is sequentially simulated by fixedly setting the dimension in the plane direction of the second conductor layer 42 and gradually increasing the dimension in the plane direction of the first conductor layer 41 from a state where it is the same as the dimension in the plane direction of the second conductor layer 42.

FIG. 5 depicts a simulation result obtained by increasing the width d shown in FIG. 2 from 0 [mm] to d1 [mm]. FIG. 6 depicts a simulation result obtained by increasing the width d from d1 [mm] to d2 [mm]. FIG. 7 depicts a simulation result obtained by increasing the width d from d2 [mm] to d3 [mm].

In the meantime, a horizontal axis in FIGS. 5 to 7 indicates the radiation angle [deg] of the electromagnetic wave W to be radiated from the antenna 3. Also, a vertical axis in FIGS. 5 to 7 indicates a gain [dB] of the electromagnetic wave W to be radiated from the antenna 3. The bold solid line shown in FIGS. 5 to 7 is a waveform indicating the gain characteristic of the microstrip antenna 1, and the dotted line shown in FIGS. 5 to 7 is a waveform indicating the ideal gain characteristic.

As shown in FIG. 5, when the width d is increased from 0 [mm] to d1 [mm], the phase of the electromagnetic wave to be radiated from the first conductor layer 41 approaches to the antiphase of the phase of the electromagnetic wave to be radiated from the second conductor layer 42, so that the gain characteristic approaches to the ideal gain characteristic.

Also, as shown in FIG. 6, when the width d is increased from d1 [mm] to d2 [mm], the phase of the electromagnetic wave to be radiated from the first conductor layer 41 deviates from the antiphase of the phase of the electromagnetic wave to be radiated from the second conductor layer 42, so that the gain characteristic deviates from the ideal gain characteristic.

Also, as shown in FIG. 7, when the width d is increased from d2 [mm] to d3 [mm], the phase of the electromagnetic wave to be radiated from the first conductor layer 41 again approaches to the antiphase of the phase of the electromagnetic wave to be radiated from the second conductor layer 42, so that the gain characteristic approaches to the ideal gain characteristic.

Like this, when the width d is gradually increased, the gain characteristic of the microstrip antenna 1 periodically approaches to the ideal gain characteristic due to the change of the phase of the electromagnetic wave to be radiated from the first conductor layer 41. For this reason, for the microstrip antenna 1, d1 [mm] is adopted as the width d from the simulation result, in which the gain characteristic is most close to the ideal gain characteristic, of the plurality of simulation results.

Thereby, as shown in FIG. 8, in the microstrip antenna 1, the electromagnetic wave W11 to be radiated from the first conductor layer 41 and the electromagnetic wave W21 to be radiated from the second conductor layer 42 are cancelled with each other, as shown with the dotted arrow in FIG. 8. Therefore, according to the microstrip antenna 1, it is possible to suppress the change of the ideal gain characteristic of the electromagnetic wave W to be radiated from the antenna 3.

Meanwhile, in the microstrip antenna 1, when a frequency of the electromagnetic wave to be radiated from the antenna 3 is changed, wavelengths of the electromagnetic waves to be radiated from the first conductor layer 41 and the second conductor layer 42 are changed. Specifically, when the frequency of the electromagnetic wave to be radiated from the antenna 3 becomes higher, the wavelengths of the electromagnetic waves to be radiated from the first conductor layer 41 and the second conductor layer 42 are shortened. Also, when the frequency of the electromagnetic wave to be radiated from the antenna 3 becomes lower, the wavelengths of the electromagnetic waves to be radiated from the first conductor layer 41 and the second conductor layer 42 are lengthened.

For this reason, the width d, which is a difference between the dimensions in the plane direction of the first conductor layer 41 and the second conductor layer 42, is determined on the basis of the frequency of the electromagnetic wave to be radiated from the antenna 3. For example, in case that the optimal width d at any frequency of the electromagnetic wave W to be radiated from the antenna 3 is the width d1 [mm], when a frequency of the electromagnetic wave W is set higher than any frequency, the optimal width d is made shorter than the width d1 [mm], in correspondence to the frequency of the electromagnetic wave W.

Thereby, even when the frequency of the electromagnetic wave W to be radiated from the antenna 3 is changed, the microstrip antenna 1 can suppress the change of the ideal gain characteristic of the electromagnetic wave W.

Also, in the microstrip antenna 1, a phase difference between the electromagnetic waves to be radiated from the first dielectric layer 21 and the second dielectric layer 22 is also changed due to a thickness of the first dielectric layer 21 or the second dielectric layer 22. For this reason, the width d, which is a difference of the dimensions in the plane direction of the first conductor layer 41 and the second conductor layer 42, is determined on the basis of the thickness of the first dielectric layer 21 or the second dielectric layer 22.

For example, when the optimal width d of the microstrip antenna 1 shown in FIG. 2 is the width d1 [mm], the optimal width d is set shorter than the width d1 [mm] in a microstrip antenna of which a thickness of the first dielectric layer is greater than the first dielectric layer 21 of FIG. 2.

Thereby, even the microstrip antenna of which the thickness of the first dielectric layer is different from the microstrip antenna 1 shown in FIG. 2 can also suppress the change of the ideal gain characteristic of the electromagnetic wave to be radiated from the antenna.

In the meantime, the configuration of the microstrip antenna 1 shown in FIGS. 1, 2 and 8 is just an example, and the configuration of the microstrip antenna 1 in accordance with the illustrative embodiment can be diversely modified. In the below, a microstrip antenna 1*a* in accordance with a modified embodiment of the illustrative embodiment is described with reference to FIG. 9.

Figure 9:
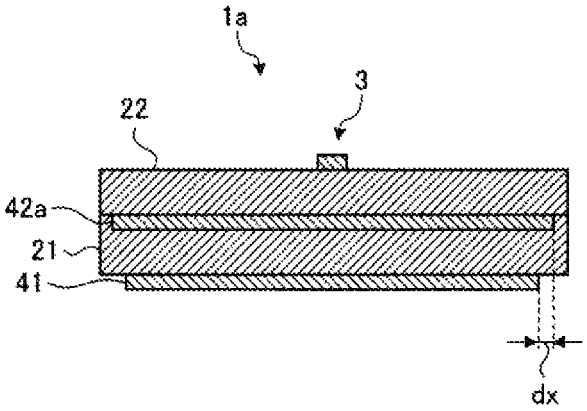
FIG. 9 is a sectional view of a microstrip antenna in accordance with a modified embodiment of the illustrative embodiment.

FIG. 9 is a sectional view of the microstrip antenna 1*a* in accordance with the modified embodiment of the illustrative embodiment. In the meantime, the constitutional elements, which have the same shapes as the constitutional elements shown in FIG. 2, of the microstrip antenna 1*a* shown in FIG. 9 are denoted with the same reference numerals as those in FIG. 2, and the descriptions thereof are omitted.

As shown in FIG. 9, the microstrip antenna 1*a* of the modified embodiment is different from the microstrip antenna 1, in that a dimension in the plane direction of a second conductor layer 42*a* is greater than the dimension in the plane direction of the first conductor layer 41.

Like this, in the microstrip antenna 1*a*, the dimension in the plane direction of the first conductor layer 41 provided on the lower surface of the first dielectric layer 21 is smaller than the dimension in the plane direction of the second conductor layer 42*a* provided on the upper surface of the first dielectric layer 21.

Specifically, in the microstrip antenna 1*a*, each side end surface of the second conductor layer 42*a* is made to more protrude outward in the horizontal direction than each side end surface of the first conductor layer 41 by a width dx. The width dx is determined by a simulation similar to the above-described simulation.

That is, regarding the width dx, a width at which the electromagnetic wave to be radiated from the first conductor layer 41 and the electromagnetic wave to be radiated from the second conductor layer 42*a* are to be cancelled with each other is determined by a simulation. Thereby, the microstrip antenna 1*a* can suppress the change of the ideal gain characteristic of the electromagnetic wave to be radiated from the antenna 3.

In the meantime, as described above, the microstrip antenna 1 of the illustrative embodiment can be applied to a receiving antenna of the radar device, too. When the microstrip antenna 1 is applied to a receiving antenna of the radar device, a part of the electromagnetic wave to be originally received may be incident to the first conductor layer 41 and the second conductor layer 42. The first conductor layer 41 and the second conductor layer 42 radiate the incident electromagnetic wave, as described above.

Even in this case, the electromagnetic waves to be radiated from the first conductor layer 41 and the second conductor layer 42 are cancelled with each other, so that the microstrip antenna 1 can suppress the change of the ideal gain characteristic of the electromagnetic wave to be radiated from the antenna 3 and the bad influence on the directionality of the antenna 3.

Meanwhile, in the illustrative embodiment, the length of the conductor layer is adjusted in correspondence to the frequency of the electromagnetic wave, the thickness of the dielectric and the like. However, the length of the conductor layer may also be adjusted on the basis of parameters (for example, a dielectric constant of the dielectric, and the like other than the frequency and the thickness.

Also, in the illustrative embodiment, the conductor layer has a square shape, as seen from above. However, the planar shape of the conductor layer is not limited thereto. For example, the planar shape of the conductor layer may be a rectangular shape or may be a polygonal shape except for the tetragonal shape. Also, a shape of an end edge of the conductor layer as seen from above may be a wave shape or a serration shape.

Like this, even though the conductor layer has any planar shape, when the dimensions in the plane direction of the upper conductor layer and the lower conductor layer are adjusted to be different from each other so that the electromagnetic waves to be radiated from the conductor layers are to be cancelled with each other, the microstrip antenna can suppress the change of the ideal gain characteristic of the electromagnetic wave to be radiated from the antenna.

The additional effects and modified embodiments can be easily conceived by one skilled in the art. For this reason, the wider aspect of the disclosure is not limited to the specific details and representative illustrative embodiment described in the above. Therefore, a variety of changes can be made without departing from the spirit or scope of the general disclosure defined by the claims and equivalents thereto.

What is claimed is:

1. A microstrip antenna comprising:

a plurality of stacked dielectric layers;

an antenna including a plurality of radiation elements disposed parallel to each other and symmetrically connected to a power feeding line, wherein the radiation elements are provided on an uppermost dielectric layer of the plurality of dielectric layers;

the power feeding line being configured to feed high-frequency power to each radiation element; and first and second conductor ground layers respectively provided on lower surfaces of the dielectric layers and disposed symmetrically to each other, and are not electrically connected with the antenna, the conductor ground layers having different dimensions in a plane direction thereof so that electromagnetic waves to be radiated from end portions of the conductor ground layers become antiphases with respect to each other and the electromagnetic waves to be radiated are cancelled with each other, thereby suppressing bad influence on the directionality of the antenna;

wherein the dimension of the second conductor ground layer provided on the lower surface of one of the dielectric layers in the plane direction thereof, is smaller than the dimension of the first conductor ground layer, which is provided on a lower surface of another one of the dielectric layers, the another one of the dielectric layers being provided above the one of the dielectric layers in the plane direction thereof, and wherein the microstrip antenna has a planar shape and is connected to an MMIC (Monolithic Microwave Integrated Circuit).

* * * * *